US006510879B1

(12) United States Patent
Chuang

(10) Patent No.: US 6,510,879 B1
(45) Date of Patent: Jan. 28, 2003

(54) DEVICE OF DEPTH INDEX OF A PLANING MACHINE

(76) Inventor: Bor Yann Chuang, No. 78, Yungfeng Rd., Taiping Shiang, Taichung (TW), 411

( * ) Notice: Subject to any disclaimer, the term of this patent is extended or adjusted under 35 U.S.C. 154(b) by 0 days.

(21) Appl. No.: 09/981,716

(22) Filed: Oct. 19, 2001

(51) Int. Cl.[7] ..... B27C 1/02

(52) U.S. Cl. ..... 144/130; 33/642; 33/791; 144/114.1; 144/117.1; 144/356; 144/382; 409/210; 409/214

(58) Field of Search ..... 33/642, 791; 83/522.19; 144/114.1, 117.1, 130, 356, 382, 129, 357; 409/210, 214

(56) References Cited

U.S. PATENT DOCUMENTS 5,967,205 A * 10/1999 Welsh et al. ..... 144/130
6,131,628 A * 10/2000 Chiang ..... 144/130
6,279,628 B1 * 8/2001 Chang ..... 144/130
6,308,754 B1 * 10/2001 Chang ..... 144/130
6,308,755 B1 * 10/2001 Chiang ..... 144/130

* cited by examiner

*Primary Examiner*—W. Donald Bray
(74) *Attorney, Agent, or Firm*—Troxell Law Office PLLC

(57) ABSTRACT

A device of depth index of a planing machine includes a bottom base, an upper base, an index device and a sensor device. The upper base is fitted with an index device at a preset position in the front. A push rod is pushed up to activate the index device to show a planing depth. The sensor device includes a sensing strip pivotally connected to a preset position under the upper base. As soon as contacting with a wood material moving on the bottom base, the sensing strip will rotate for a preset angle and prop up the push rod to let it activate the index device to show a numerical value of planing depth. As the sensing strip is elongate, a wood material moving on the bottom base can immediately sensed by it, no matter what size or where or how it is placed, obtaining effect of wholly sensing the wood material being planed and ensuring measuring precision.

7 Claims, 4 Drawing Sheets

DEVICE OF DEPTH INDEX OF A PLANING MACHINE

BACKGROUND OF THE INVENTION

This invention relates to a device of depth index of a planing machine, particularly to one having functions of wholly sensing a planing depth of a wood material, possible to prevent the wood material being planed from withdrawing abnormally, and ensure safety in handling.

A conventional device of depth index of a planing machine includes a small-sized index meter positioned exactly in the center in a planing table, and a sensing rod is provided under the index meter for measuring a planing depth of wood material. In using, a wood material has to be placed exactly under the sensing rod and let them touch each other and thus the index meter can show a planed depth of the wood material in accordance with the movement of the sensing rod.

However, if the wood material being planed is too narrow or isn't placed exactly on a center position, it will fail to touch the sensing rod, and therefore it is impossible to measure a planing depth of the wood material. Besides, when a wood material is pushed forward straightly and proceeds to contact in a twinkling with a plane knife rotating at an extremely high speed, a withdrawing condition of the wood material may be liable to occur occasionally due to non-smooth contact or great vibration, consequently increasing danger to a handling worker, because of no stopping device in the conventional planing machine.

SUMMARY OF THE INVENTION

The main objective of this invention is to offer a device of depth index of a planing machine having an elongate sensing strip, capable to sense wood material moving on the bottom base of a planing machine. Even if the wood material is a small one, it can sense wholly the wood material being planed and ensuring measuring precision.

Another objective of this invention is to offer a device of depth index of a planing machine having a sensing strip provided slanting toward the interior of the planing machine and having its front edge formed with ratchet-like stop teeth to prevent the wood material being planed from withdrawing abnormally, increasing safety in operating.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
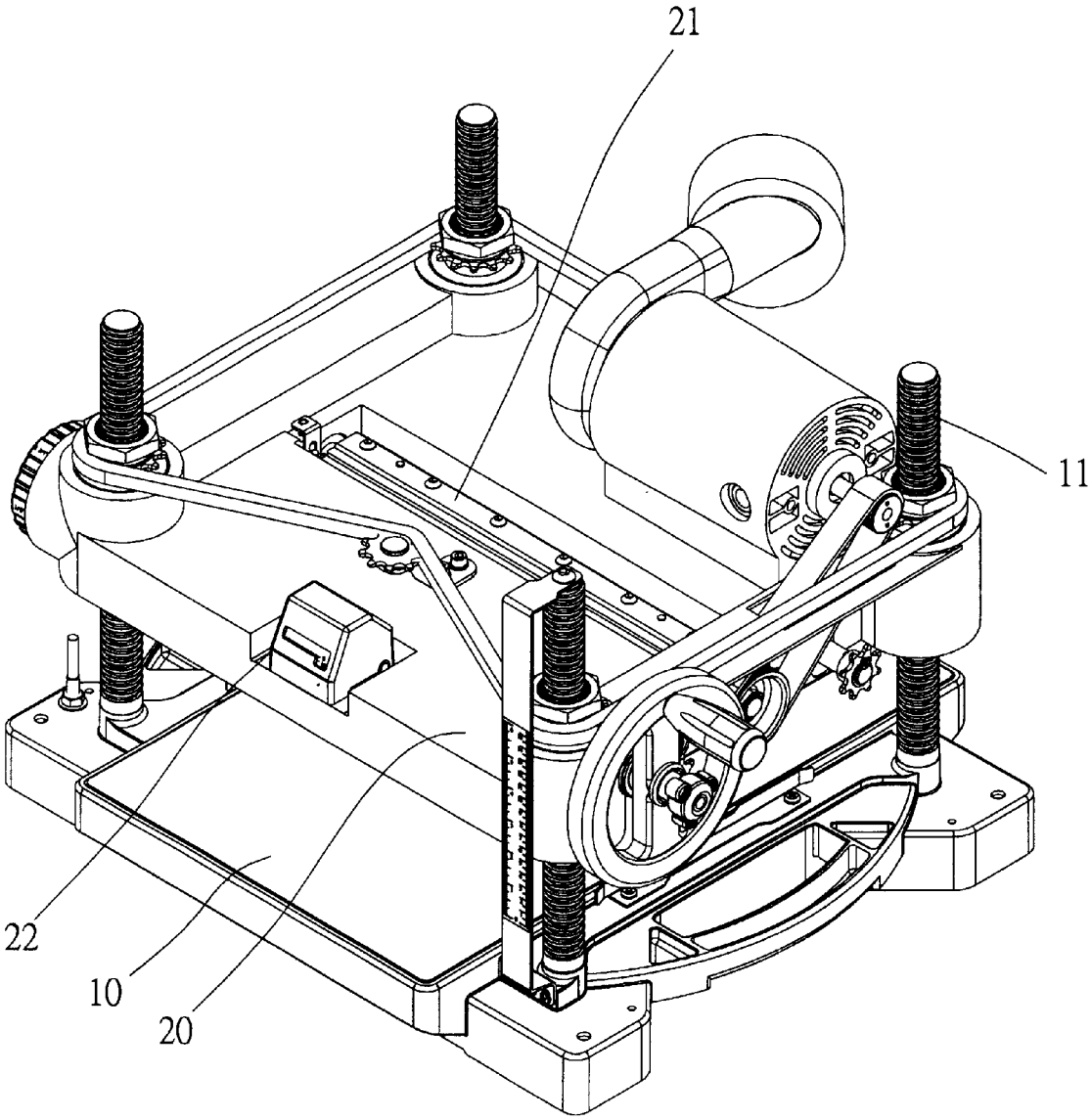
FIG. 1 is a perspective view of a planing machine with a device of depth index in the present invention.
Figure 2:
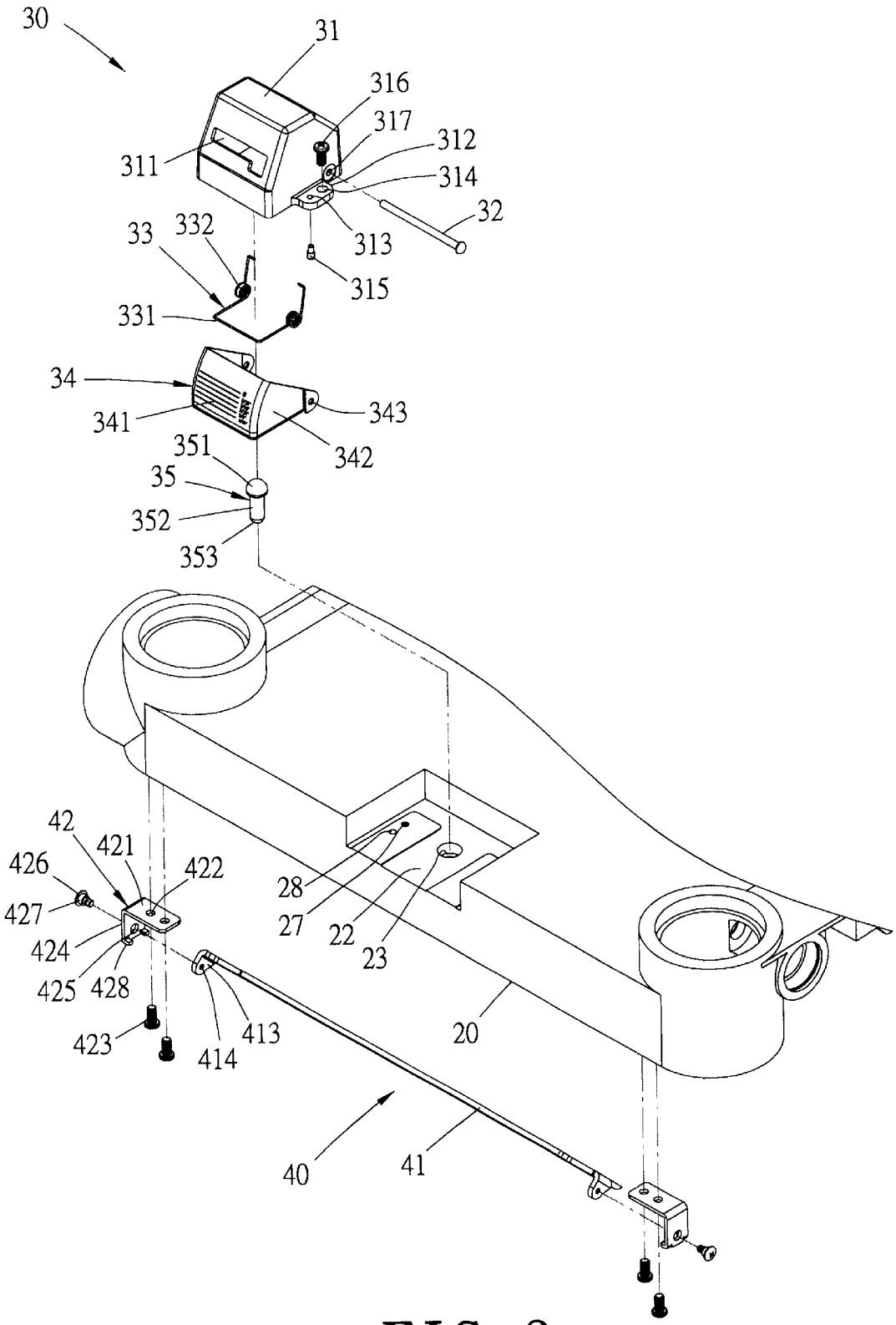
FIG. 2 is an exploded perspective view of the device of depth index of a planing machine in the present invention.

A preferred embodiment of a device of depth index of a planing machine in the present invention, as shown in FIGS. 1 and 2, includes a bottom base 10, an upper base 20, an index device 30 and a sensor device 40 as main components combined together.

The upper base 20 is positioned on the bottom base 10 and screwed with each other by threaded rods at four corners of the bottom base 10, capable to move up and down. A plane knife 21 is fixed in the center of the upper base 20 for planing off a wood material and making it smooth when the wood material is passing under the upper base 20.

Figure 4:
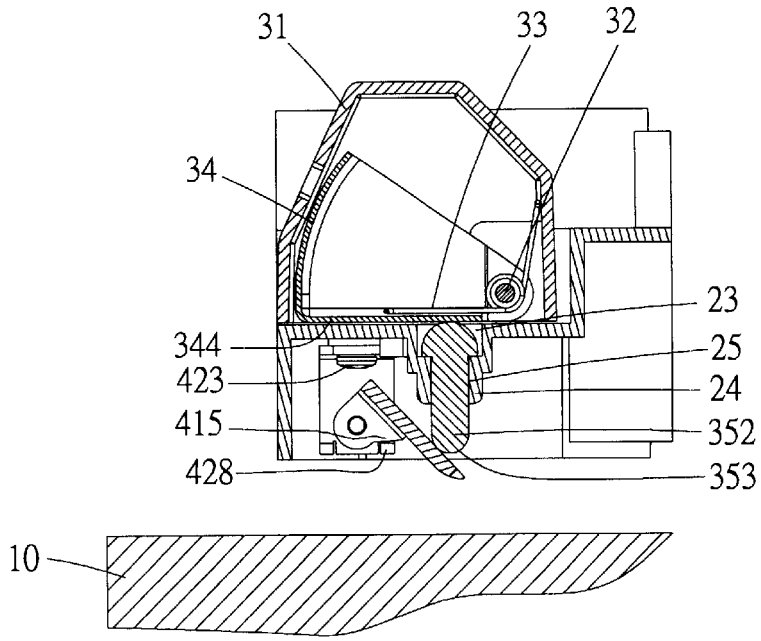
FIG. 4 is a cross-sectional view of the sensing strip in a non-sensing condition in the present invention.

Besides, the upper base 20 has a recessed groove 22 formed in a front center and having a hole 23 in the center of the bottom surface, as shown in FIG. 4. A guide rod 24 formed integral is positioned at the bottom of the groove hole 23, having a guide hole 25 of a relatively small diameter formed in its interior and communicating with the groove hole 23 above. Then, the recessed groove 22 of the upper base 20 has a screw hole 26 and a pin hole 27 respectively in opposite sides, as shown in FIG. 2.

An index device 30, as shown in FIG. 2, includes an index casing 31 having a transparent window 311 in a front surface and a connect base 312 protruding out of opposite sides. The connect base 312 has a pin hole 313 for the upper portion of an insert pin 315 to insert therein, with the lower portion of the insert pin 315 inserted in the pin hole 28 of the recessed groove 22 of the upper base 20, and a locking hole 314 screwed with the screw hole 27 of the recessed groove 22 with a screw 316, making the index device 30 firmly fitted in the recessed groove 22 of the upper base 20. A shaft hole 317 is bored at opposite lower sides for receiving a shaft rod 32, and a spring unit 33 has a U-shaped press member 331 extending forward, having a pivotal hole 332 at opposite sides to be inserted therein by two ends of the shaft rod 32.

Next, an U-shaped index plate 34 is provided, having a front plate with a digit index on its surface and opposite side plates 342 with two shaft holes 343 respectively formed at an end for receiving the shaft rod 32. The index casing 31 is located outside the spring 33, as shown in FIG. 4. The index plate 34 is further provided with a bottom plate 344 to be compressed by the press member 331 of the spring unit 33 so as to let the bottom plate 344 normally facing or touching the groove surface of the recessed groove 22 of the upper base 20. Additionally, a push rod 35 having a semi-spherical head 351 is positioned in the groove hole 23 of the recessed groove 22, with an intermediate round rod portion 352 received in the guide hole 25 of the guide rod 24 and capable to move up and down therein and having an arc-shaped bottom protruding out.

Figure 3:
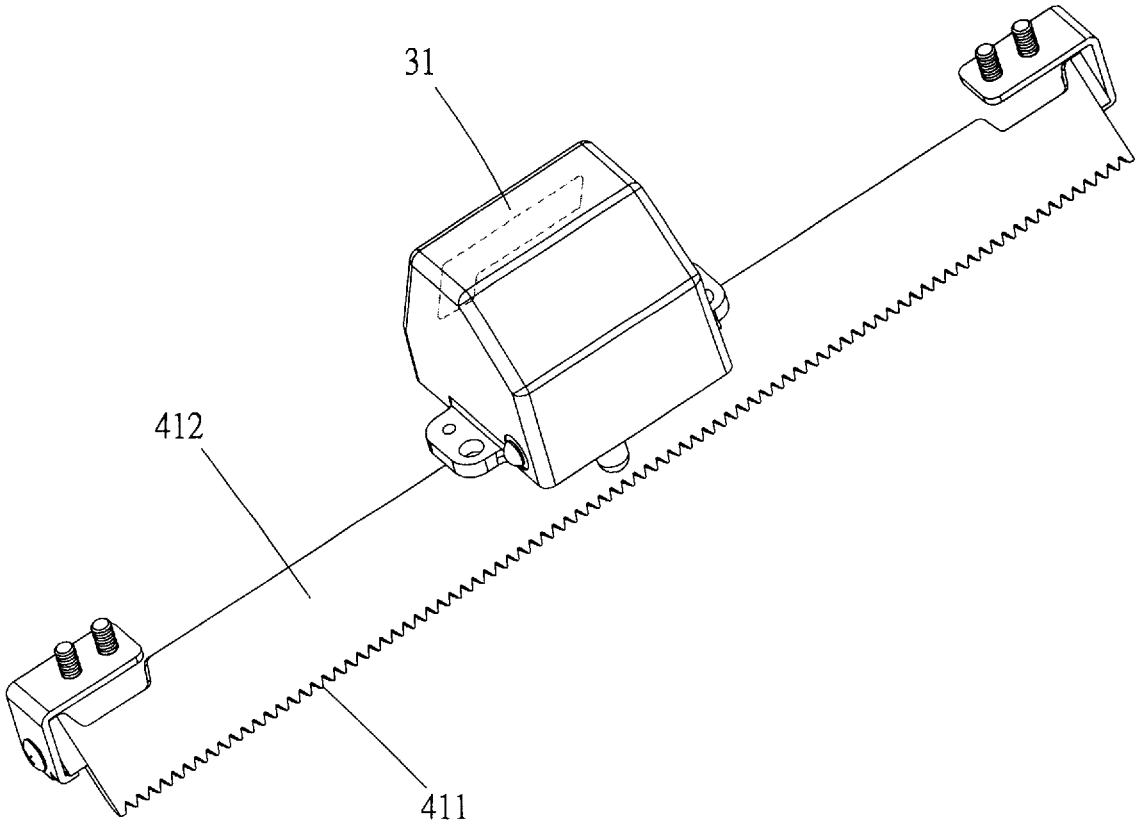
FIG. 3 is a perspective view of a sensing strip contacting with a push rod in the present invention.

A sensor device 40, as shown in FIGS. 2 and 3, includes a sensing strip 41 and two L-shaped fixing members 42. The sensing strip 41 is elongate, and its length is generally equal to the width of the bottom base for receiving wood material on the bottom base 10. The sensing strip 41 has its front edge formed with ratchet-like stop teeth 411 and its top as a guide surface 412. Then, a fixing member 413 of a preset length is vertically formed at the opposite ends of the sensing strip 41, having a locking hole 414 in the center.

In addition, the two fixing members 42 are oppositely positioned, respectively having on top with a lateral plate 421 with two locking holes 422 for two screws 423 to screw therein and firmly fix two fixing strips 42 on a front portion of the bottom of the upper base 20. Each fixing member 42 further has a vertical plate 424, and each vertical plate 424 has a lateral through hole 425 in the center for receiving a screw 426 screwing also through the locking hole 414 and fixing the fixing members 42 and the fixing member 413 together. Further, the portion of the screw 426 contacting with the lateral through hole 425 is a round head 427 so as to let the sensing strip 41 activated to rotate. Furthermore, the vertical plate 424 of the fixing member 42 is provided with two position studs 428 protruding inward at opposite bottom sides, as shown in FIG. 4, and the sensing strip 41 is positioned slanting toward the interior of the planing machine, having a stop flat surface 415 formed on a predetermined portion of the bottom surface of the fixing member 413. When the position studs 428 of the vertical plate 424 stick the stop flat surface 415, the fixing member 413 is stopped immovable to move down no more so as to restrict a largest range for the fixing member 413 to move down.

Figure 5:
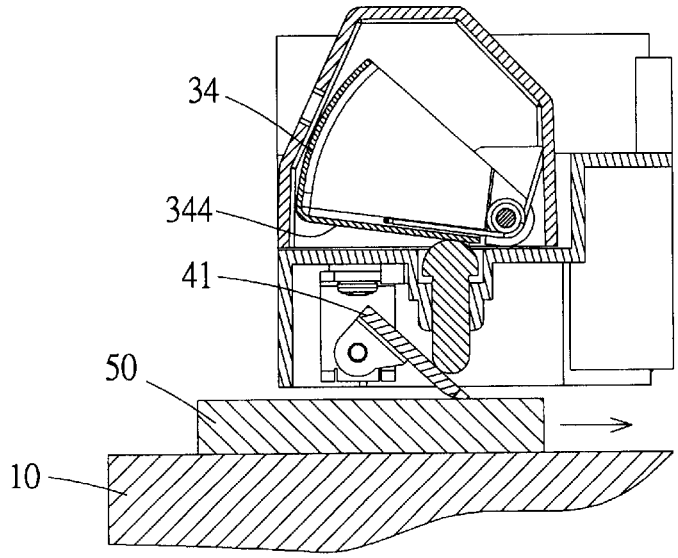
FIG. 5 is a cross-sectional view of the sensing plate in a sensing condition in the present invention.

In handling, as shown in FIG. 4, in case there is no wood material being planed, the index plate 34 is in a zero-degree position because the bottom plate 344 of the index plate 34 is compressed by the press member 331 of the spring unit 33. But, referring to FIG. 5, if a wood material moves on the bottom base 10 of a planing machine for planing, the sensing strip 41 will be pushed up by the wood material and rotates upward and props up the push rod 35 by its guide surface 412, with the round head 427 of the screw 426 serving as a shaft. And, at the same time, the semi-spherical head 351 of the push rod 35 also props up the bottom plate 344 of the index plate 34 to make it move away from the groove surface of the recessed groove 22, and meanwhile, the front plate 341 of the index plate 34 will rise, too. Thus, a user can easily know numerical value of a planing depth shown on the index plate 34 through the transparent window 311 of the index casing 31.

As the sensing strip 41 in the invention is elongate and its length is generally equal to the width of the bottom base 10, therefore any wood material will be immediately sensed by the sensing strip 41 so long as the wood material is moved on the bottom base 10, having effect of wholly sensing a planing depth of the wood material and ensuring measuring precision, no matter what size a wood material is or where or how it is placed.

Furthermore, the sensing strip 41 is provided slanting toward the interior of the planing machine and has it front edge formed with the ratchet-like stop teeth 411 which will prevent a wood material from retreating during planing, greatly elevating safety in handling.

While the preferred embodiment has been described above, it will be recognized and understood that various modifications may be made therein and the appended claims are intended to cover all such modifications that may fall within the spirit and scope of the invention.

I claim:

1. A depth index device of a planing machine comprising a bottom base, an upper base, an index device and a sensor device, said upper base movably positioned on said bottom base so as to move up and down with respect to said bottom base, said index device provided on a front portion of said upper base, and including a movable push rod passing through and protruding out of said upper base, upward movement of said push rod activating said index device to show a planing depth: and, the sensor device having an elongate sensing strip pivotally connected to said upper base, said sensing strip pivotable through a preset angle, movement of said sensing strip moving said push rod to activate said index device to show a numerical value of a planing depth, when said sending strip is contacted by a workpiece moving on said bottom base.

2. The depth index device of a planing machine as claimed in claim 1, wherein said sensing strip has a front edge formed with stop teeth.

3. The depth index device of a planing machine as claimed in claim 1, wherein fixing members are vertically formed at opposite ends of said sensing strip.

4. The depth index device of a planing machine as claimed in claim 3, wherein said sensor device further includes two L-shaped fixing members, each said fixing member having a top with a lateral plate with locking holes therein, and a side vertical plate having a lateral through hole in a center and a screw inserted through said locking hole of said fixing member, said screw having a portion contacting said lateral through hole so as to enable said sensing strip to pivot.

5. The depth index device of a planing machine as claimed in claim 1, wherein said upper base has a recessed groove in a front center receiving said index device, said recessed groove having a center groove hole with a guide rod fitted thereunder, said guide rod having a guide hole communicating with groove hole of said recessed groove.

6. The depth index device of a planing machine as claimed in claim 5, wherein said push rod has a semi-spherical head fitted in said groove hole, an intermediate round rod portion received in said guide hole of said guide rod, and an arc-shaped bottom end.

7. The depth index device of a planing machine as claimed in claim 4, wherein said vertical plate of each fixing member has two position members protruding horizontally inwardly at opposite bottom ends.

* * * * *